United States Patent [19]

Neuhaus

[11] Patent Number: 4,870,315

[45] Date of Patent: Sep. 26, 1989

[54] SWINGING GARBAGE PAIL AND CABINET DOOR COUPLING MECHANISM

[75] Inventor: Josef Neuhaus, Arnsberg, Fed. Rep. of Germany

[73] Assignee: Westermann Kommanditgesellschaft, Arnsberg, Fed. Rep. of Germany

[21] Appl. No.: 151,124

[22] Filed: Feb. 1, 1988

[30] Foreign Application Priority Data

Feb. 6, 1987 [DE] Fed. Rep. of Germany ..... 3703544

[51] Int. Cl.[4] ..... A47B 81/00

[52] U.S. Cl. ..... 312/309; 312/275

[58] Field of Search ..... 312/275, 276, 310, 23, 312/26, 24, 25, 309

[56] References Cited

U.S. PATENT DOCUMENTS

| | | | |
|---|---|---|---|
| 1,749,865 | 3/1930 | Wellington | 312/275 |
| 2,152,378 | 3/1939 | Gelbaugh | 312/275 |
| 2,311,835 | 2/1943 | Johnson | 312/275 |
| 2,837,395 | 6/1958 | Carani | 312/275 X |
| 3,014,684 | 12/1961 | Gould | 312/275 X |

FOREIGN PATENT DOCUMENTS

| | | | |
|---|---|---|---|
| 7405438 | 2/1974 | Fed. Rep. of Germany . | |
| 2916183 | 4/1979 | Fed. Rep. of Germany . | |
| 3516101 | 6/1985 | Fed. Rep. of Germany . | |
| 1169313 | 3/1957 | France | 312/275 |
| 197830 | 2/1938 | Switzerland | 312/275 |
| 249608 | 6/1946 | Switzerland | 312/275 |

*Primary Examiner*—Joseph Falk

*Attorney, Agent, or Firm*—Martin A. Farber

[57] ABSTRACT

Garbage pail adapted to be installed in a cabinet having a swinging access door, with a bearing axis extending vertically, laterally of the wall surface of the pail, on which axis there is seated a pail support, and a pail coupling for movement of the pail in response to opening of the door, the coupling being both automatically mechanically and/or manually disengageable and, upon closing of the door, automatically reengageable.

13 Claims, 7 Drawing Sheets

SWINGING GARBAGE PAIL AND CABINET DOOR COUPLING MECHANISM

FIELD AND BACKGROUND OF THE INVENTION

The present invention relates to a garbage pail adapted to be installed in cabinets having a swingable door, with the bearing axis of the cabinet door extending verticaly, laterally of the wall surface of the pail, on which axis there is seated a support which bears the pail, and having coupling means for attaching the pail to the door.

One structure of this type is known from Federal Republic of Germany Pat. No. 2,916,183. In that device the coupling means consists of a driving pin which is fastened on the door and which engages behind a profiled ring on the bottom of the pail support. The attaching of the pail to the door can be effected by the partial dismantling of such couplng means. This, however, as a general rule, encounters limitations, so that one must manage as best one can, for instance, in order to clean the inside of the cabinet. On the one hand, that development, which is conceived of practically as a permanent attachment, also results in difficulties from a mounting standpoint, for instance, in the manner that the suspension from the hinge pins must be coordinated with the suspension of the driving pin. On the other hand, said attachment of the pail to the door results, as a rule, in a limiting of the swing of the door to about 90°.

SUMMARY OF THE INVENTION

The object of the present invention is to develop a garbage pail of this kind, without additional expense for apparatus, in a manner which is favorable with respect to use and maintenance so that, on the one hand, the accessibility for, for instance cleaning of the cabinet space in which the pail is received is improved while, on the other hand, mounting is easier and the limiting of the opening, which has always been considered disadvantageous, is eliminated.

According to the invention the coupling means (K) are disengageable.

As a result of the present invention there is obtained a garbage pail attachment which is simple to manufacture and favorable in use and, in particular, favorable for cleaning. The coupling means can be automatically disconnected by swinging the door. This permits free access both to the parts of the door, which otherwise are practically inaccessible or only accessible with difficulty, as well as to the pail and its support. With a suitable hinge, the doors can even be swung open, for instance, by 180°. The corresponding free swinging of the pail and its support also affords unimpeded access to the inside of the cabinet.

A particularly advantageous solution, both from standpoint of mounting and of use, is furthermore obtained in the manner that the interengagement of the coupling means is automatically brought about by the closng movement of the door. The person replacing the now emptied or cleaned the pail need no longer keep his eye on the attachment places, which are a distance from each other. Similarly, the door is also no longer in his way. He merely positions the support and the pail with respect to the cabinet, then fastens the door-side means so as then to produce the simple mechanical by merely closing the door. One advantageous embodiment consists, furthermore, of the automatic release of the coupling means upon exceeding an opening of the doors by about 90°. In this way, the pail is always pulled out, reliably, into the free-standing position, ready for removal, by using the door as a handle, and the grasping of it then is facilitated as a result of the further swinging of the door out of the region of removal. Furthermore, it is found advisable for the coupling means to consist of a guide slot and a vertically displaceable pin which is normally engaged into the guide slot. Utilizing the force of gravity, the pin drops into the guide slot for effective coupling. On the other hand, for uncoupling, regardless of what path of swing is provided for the door, it is merely necessary to lift out the pin of this coupling means.

Specifically, the pin is seated in the bottom region of the support for the pail and the guide slot is seated on the door. Furthermore, it is favorable that upon exceeding an opening position of the door of about 90°, the pin moves out of the mouth end of the guide slot so that the free swinging phase of the door follows the positively guided phase. The transition is mechanically certain and does not require any manipulation. On the other hand, the coupling position is again reached in a foolproof manner regardless of the position which has been assumed by the pail and respectively its support. For example, if this position of the pail and support is still unchanged with respect to the door, the mouth end of the guide slot catches the pin on closing the door; on the hand, if this relative position has been changed, then a sort of trap function enters into action, in the manner that a bracket which possesses the guide slot, is provided on the longitudinal end thereof facing the pin with a continuous bevel for the camming or raising of the pin into its original coupling position with the guide slot.

In order to be able to use the coupling means for either a right-hand stop or a left-hand stop, the guide slot is furthermore advantageously formed of two sections of lateral symmetry. Furthermore, the proper mounting of the coupling means is also further facilitated by the fact that in front of the mouth end of the guide slot, there is a straight section, stepped down on the pail side, which extends parallel to the inner face of the door. In this way, even in the case of pails of rectangular or square cross section, there is obtained, on the one hand, the desired space-saving neighboring position and, on the other hand, however, also the desired close but clampless parallelism. Furthermore, one advantageous feature of the invention resides in the fact that the pin has a gripable top and is vertically displaceable, with an abutment stop in a bearing bracket of the pail support. The user, can reach into the region of the slot between the door and the pail, grasp the pin simply on its top grip surface and pull it upwardly so as to disengage the coupling. Finally, it is also advantageous that the 90° swung-out position of the pail is limited by a stop. Such a solution protects the hinges and the device as a whole. Furthermore, it is favorable, in principle, to have a well-defined position of the pail in the swung-out position. Finally, another favorable solution consists of two bearing brackets arranged in 90° angular symmetry on the pail support. From this also there again results the advantage of the optional right-hand stop or left-hand stop for the support. The bearing brackets can be inexpensively molded directly on the support, when the latter is made as an injection molding and, particularly if a plastic injection molding is used.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
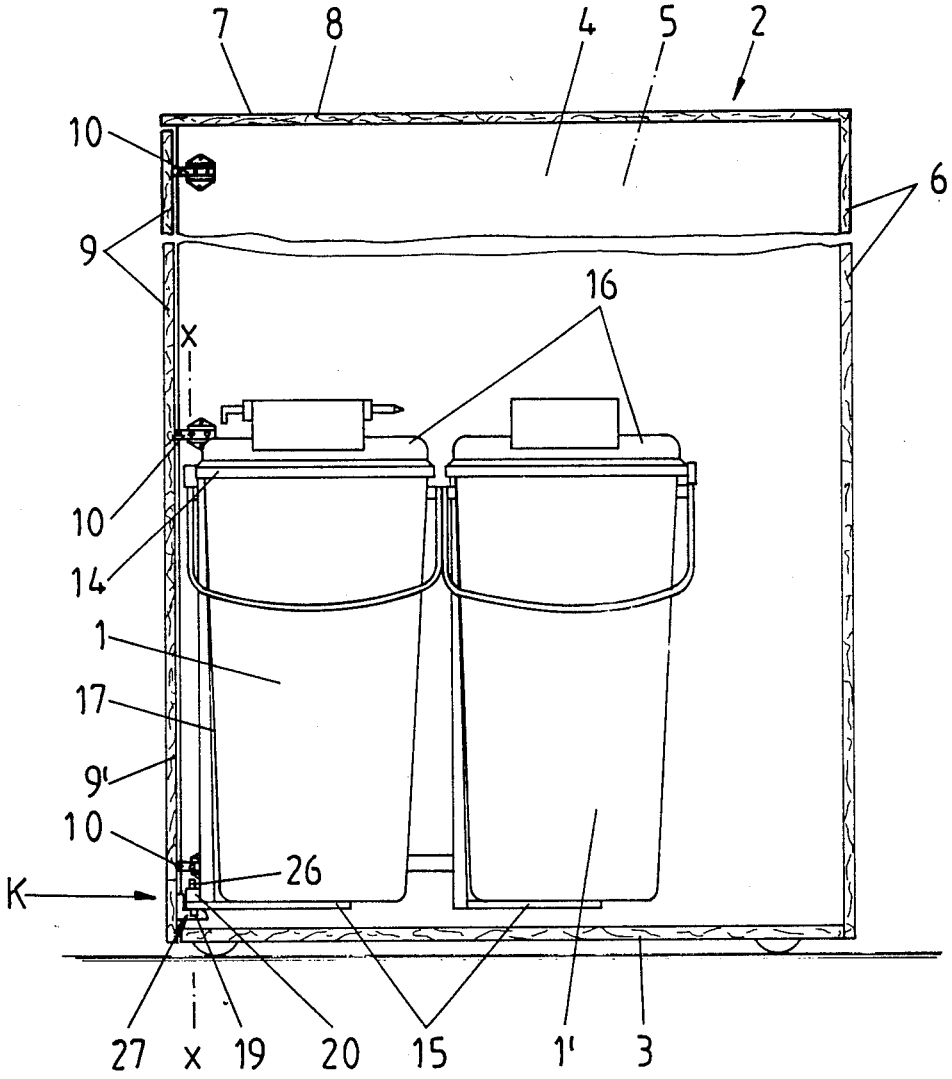
FIG. 1 is a vertical cross sectional view, showing the garbage pails in a cabinet; the pails are swung inwardly and the door is closed; also, the pails are shown seated on a support, the pails being hingedly connected to the door by a coupling means.
Figure 2:
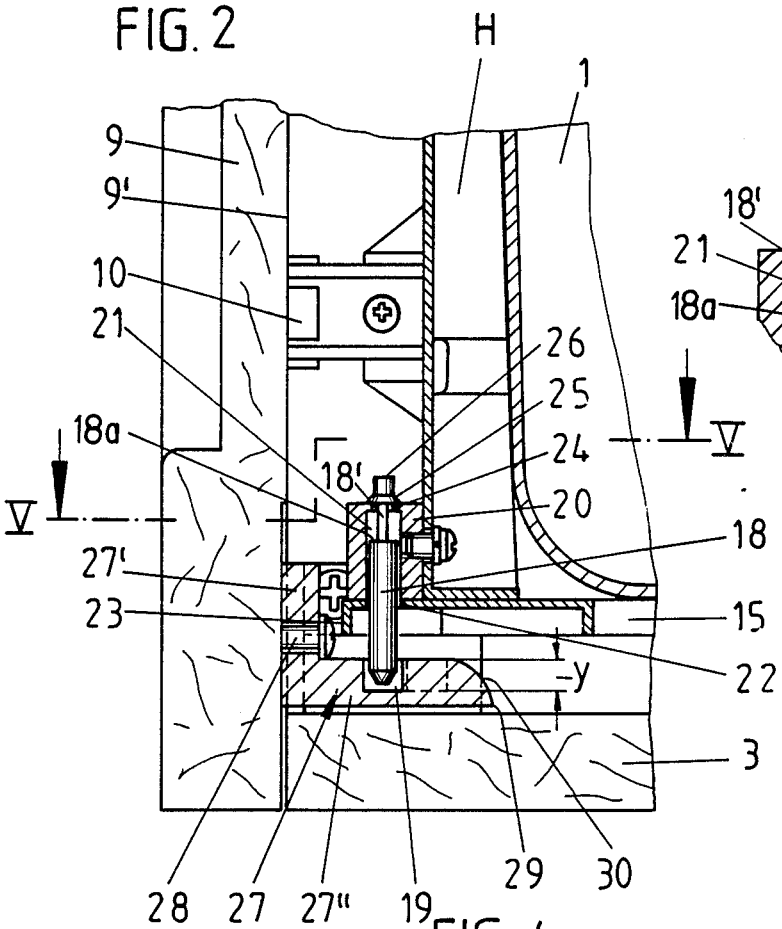
FIG. 2 is a partial enlarged front cross sectional view of the coupling means taken along the line II—II of FIG. 5.

The cabinet 2, which contains one or more garbage pails 1, 1' has a cabinet floor 3, two vertical side walls 4, 5, a cabinet rear wall 6 and a cabinet top 8 which serves as work surface 7.

The inside of the cabinet is accessible through a front door 9. This door is attached to the vertical side wall 4 of the cabinet 2 by hinges 10.

Figure 5:
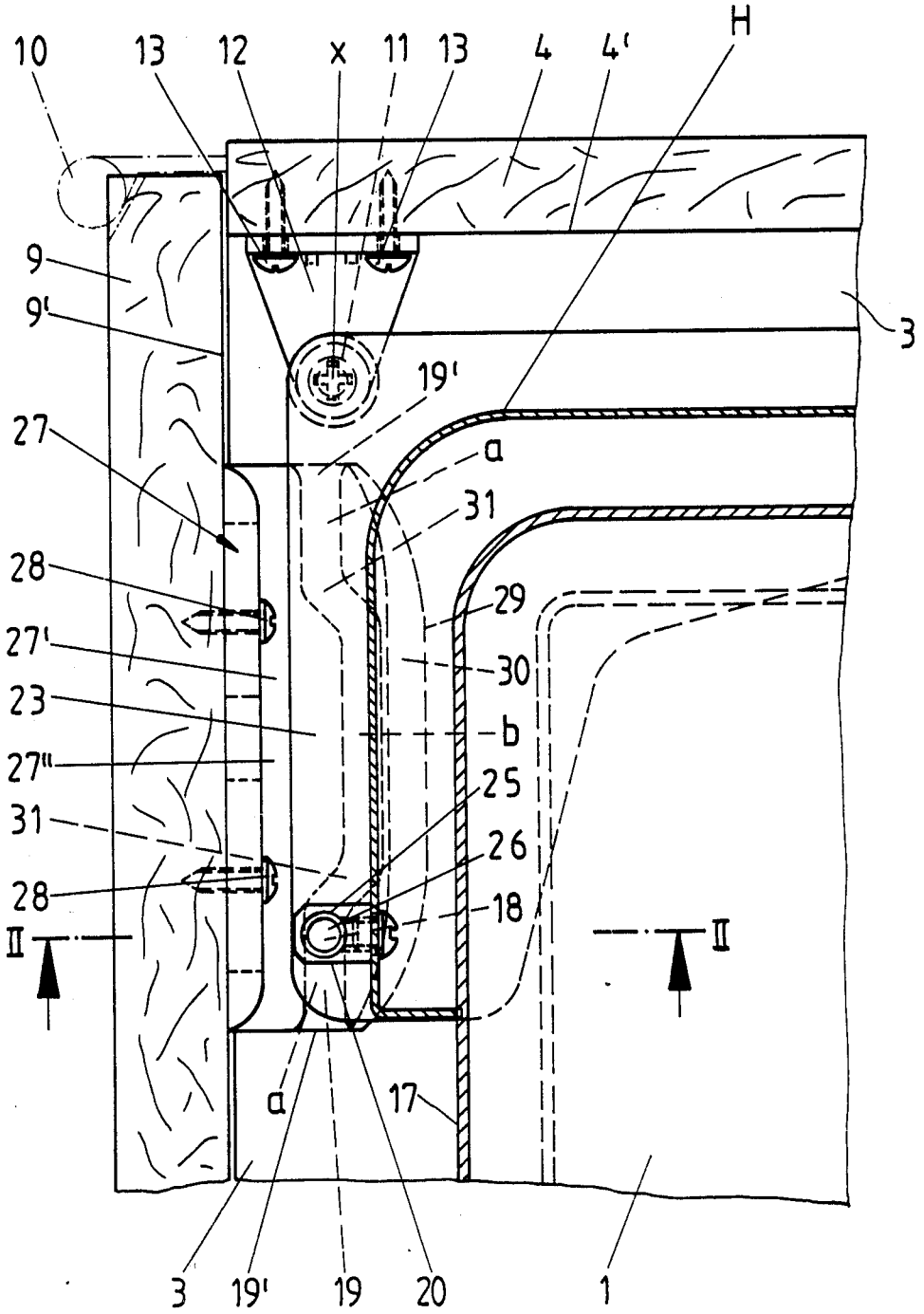
FIG. 5 is a partial cross sectional view taken along the line V—V of FIG. 2, with the cabinet door closed.
Figure 6:
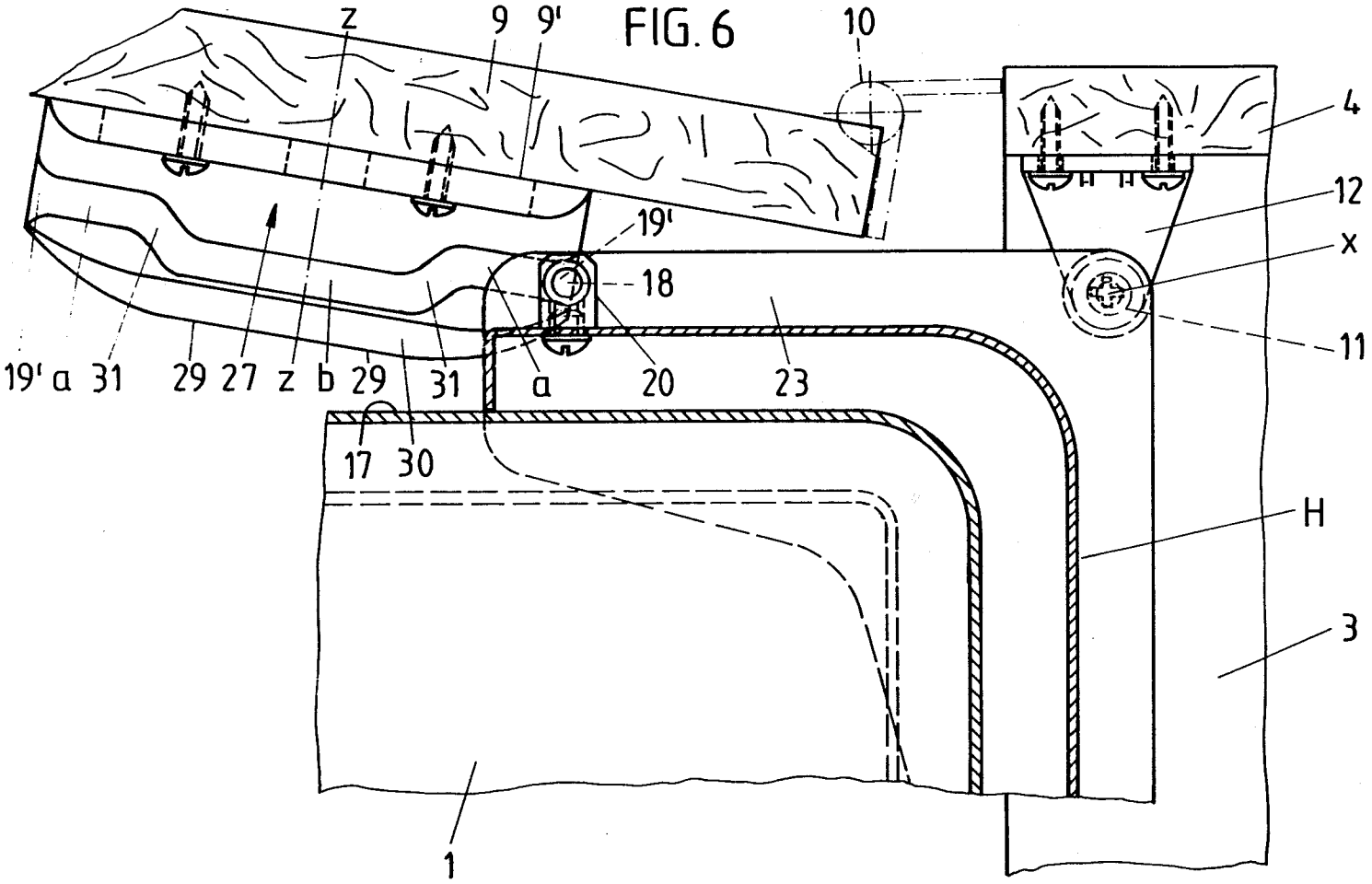
FIG. 6 is the same view as that shown in FIG. 5 but showing the automatic release means for the pails upon the door opening exceeding an open position of about 90°.

On the inner surface 4' of the vertical wall 4 there is a support H which forms a garbage pail holder. The support H swings around a vertical bearing axis x—x (see FIGS. 1 and 5) which extends parallel to the vertical wall 4 and is defined by stub shafts 11 arranged one above the other. The stub shafts are seated on one-arm or two-arm bearing bearing brackets (see FIGS. 5 and 6 showing only a lower of the bearing brackets 12). The bearing brackets 12 are attached by fastening screws 13 to the inner surface 4' of the vertical wall 4. As can be noted from FIG. 1, the vertically extending bearing axis x—x extends as close as practicable in the region of the hinge-side opening edge of the cabinet door nine.

The garbage pail support H forms, in the upper region, an angular suspension, not shown in detail, which supports a top flanged edge 14 of the garbage pails 1, 1'. In addition to this under-gripping, there is also provided a bottom-side, horizontally extending support of the garbage pails 1, 1'. The support 15 is generally shown in FIG. 1. Further technical details of the support 15 and the holding of the pail can be noted from applicant's Federal Republic of Germany Patent No. 35 16 101. Reference is also made thereto with respect to a vertical control or flipping open of the hinged covers 16 of the garbage pails 1, 1' pivoted horizontally on the cabinet side which takes place as a function of the swinging opening movement of the door 9.

The door 9 is operatively coupled to the garbage pail 1 and respectively to the support H, which supports the pails, laterally of the wall surface of the garbage pail 1. As a result of the rectangular cross section of the pail 1—and, of course, also of the pail 1'—the corresponding outer wall section of the pail 17 extends, in coupled condition of the door, substantially parallel to the inner surface 9' of the door.

The coupling means K (see FIG. 1) which connects the door and pail together is selectively releasable. It consists of a vertically arranged pin 18 and a guide slot 19 cooperating with it.

The pin 18 is located on the support H. It extends within the bottom region thereof and therefore is at the same level as the support 15; it is vertically displaceable and moves, limited by a shoulder or stop 18*a*, in a bearing block or bracket 20. The block or bracket 20 has a correspondingly vertically aligned bore 21 which lies in alignment with a mating recess 22 of a door-side lateral extension 23 of the support 15. In the top region of the bearing bracket 20, the bore 21 is reduced in cross section. The upper section of the pin 18 is also reduced down to about one-third of its initial cross section. The reduced-down section 18' extends through the top opening 24 of reduced cross section. On the top side of the pin 18 a snap holding rim 25 is formed. The bottom thereof has a frustoconical construction and continues, starting from a section of smaller cross section, coaxially into a free-standing upwardly-directed grip 26. The slot-side end of the pin 18 has a chamfered edge. The insertion of the pin 18 is effected from below and is complete after the passage of the snap rim 25 through the opening 24.

The axial stop limit for the pin 18 results from the shoulder 18*a*, obtained by the reduction of the cross section of the pin, this shoulder coming against the bottom of the top of the bearing bracket 20. Otherwise, the pin hangs downwardly from the snap rim 25. This is the basic holding or coupling position.

Figure 3:
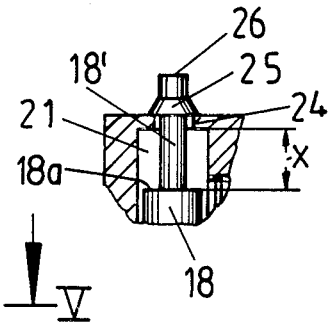
FIG. 3 is a partial enlarged view of the upper portion of the vertically displaceable pin, showing a freely accessible grip (shown on a larger scale than in FIG. 2)

The axially measured free-path stroke x (see FIG. 3) of the pin 18 corresponds at least to the depth y of the guide slot 19 cooperating with the pin.

Figure 4:
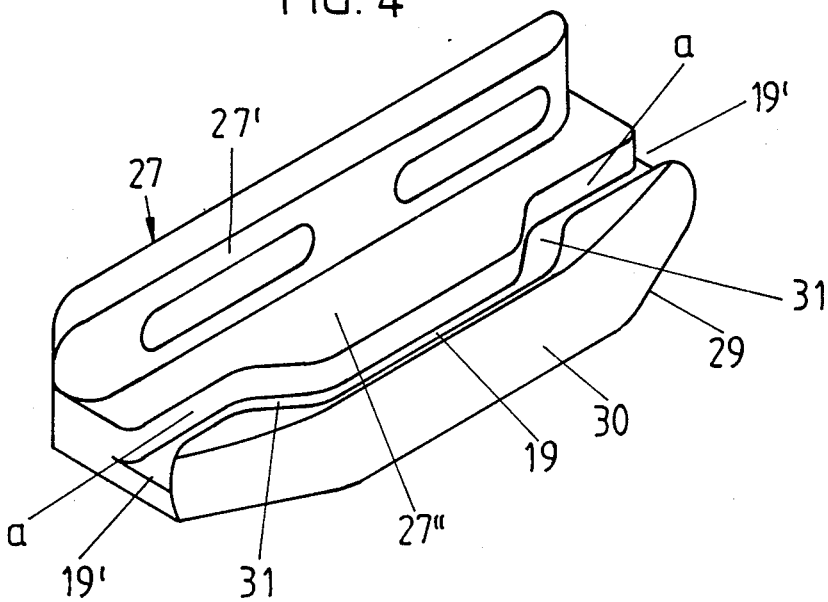
FIG. 4 is a partial cross sectional view taken along the line V—V of FIG. 2, with the cabinet.

The guide slot 19 is produced in a bracket 27 (see FIG. 4). This is a ledge-like body of generally rectangular cross section the vertical leg 27' of which is secured by holding screws 28 against the inner surface 9' of the door 9 and the horizontal leg 27" extends below the extension 23. The bracket 27 contains the upwardly open groove 19 which is aligned perpendicularly to the bearing axis x—x and forms the guide slot 19. The horizontal leg 27" is somewhat thicker than the vertical leg 27'. In order to facilitate the exact positioning end adjustment, leg 27' has two horizontal slots for sliding, horizontally of the bracket, with respect to the holding screws 28.

Figure 7:
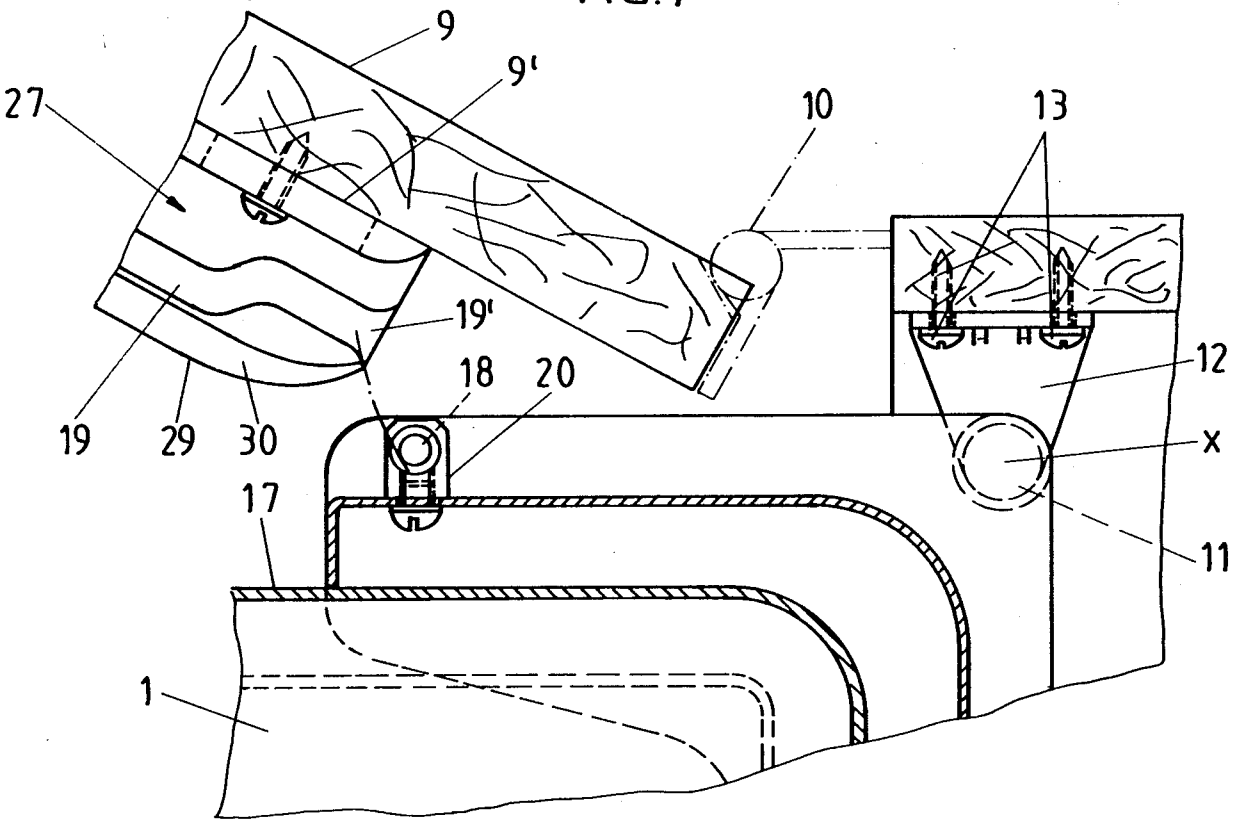
FIG. 7 shows the cabinet door release means when the opening has exceeded 90°.

The position of the pin 18 when the door 9 is closed and the length of the guide slot 19, are so adapted to each other that when an opening position of the door of more than about 90° is exceeded there is an automatic release of the coupling means K (see FIG. 6). Upon passing beyond the said 90° position of the door, the pin moves out of the mouth end 19' of the guide slot 19 facing the bearing axis x—x. In this position, the support H and the pail 1 have reached the free protruding position thereof which permits their selective desired removal (FIG. 7). On the other hand, the door 9 can be swung still further in the opening direction, for instance up to a final position of 180° with respect to the closed phase.

The mouth end 19' of guide slot 19 is developed as a funnel-shaped trap. If the support H still retains its starting position, upon the renewed closing of the door, then the guide slot 19 traps and holds the pin 18. Thus, the support and door are again mechanically coupled with each other. The inward swinging of the support which now takes place in combination with the closing of the door brings the pails back into the inside of the cabinet.

Figure 9:
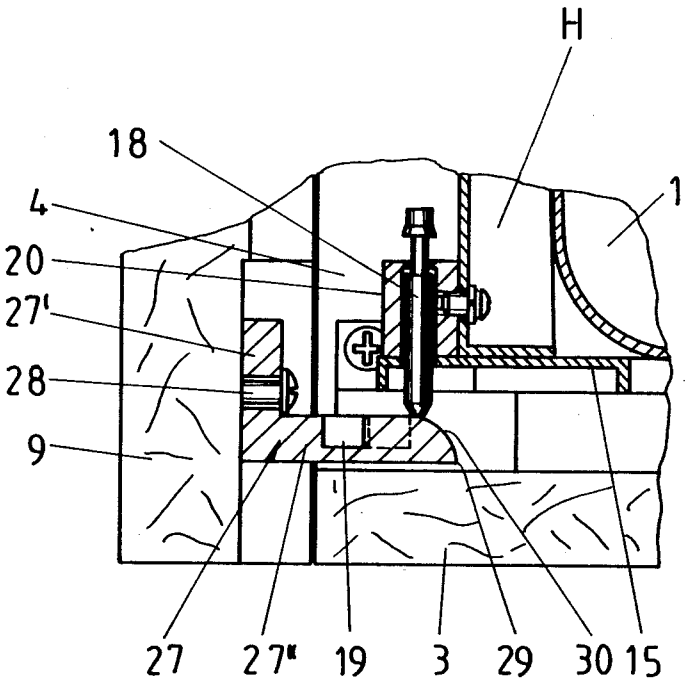
FIG. 9 is a view similar to that shown in FIG. 8 and showing the pin guided upwardly, just before it is to drop into the guide slot, upon the further closing of the door.
Figure 8:
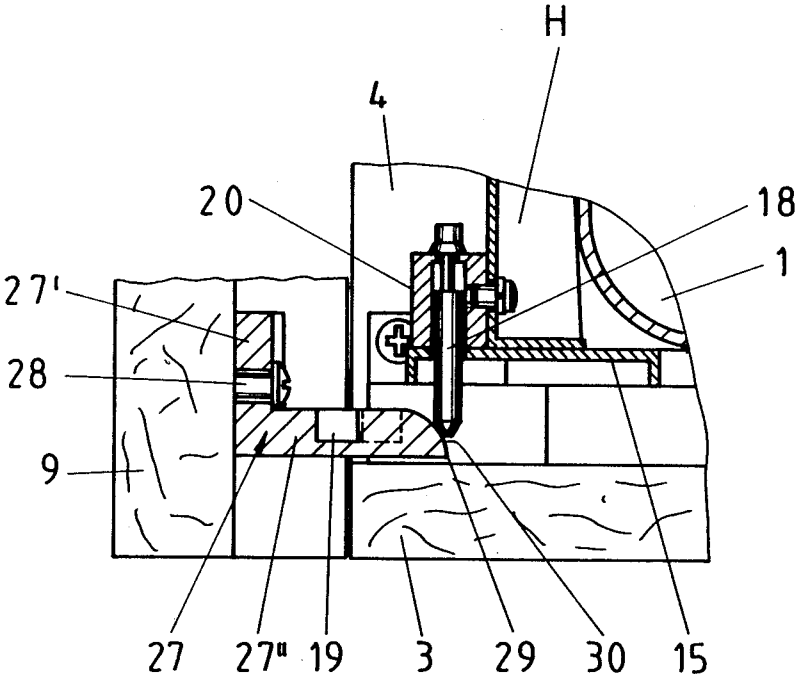
FIG. 8 is an enlarged partial cross sectional view, corresponding to FIG. 2, and showing the trap function between the pin and the bracket, before the pin has been guided into the guide slot.

However, if there is a different orientation and/or configuration the support H, for instance, if it has already swung somewhat or more into the inside of the cabinet, the pin 18, comes to bear against the longitudinal edge 29 of the bracket 27 (see FIGS. 8 and 9). The edge 28 however, has a run-on bevel 30 along the longitudinal edge 29, i.e. the edge facing the pin 18, over the entire length of the bracket 27, which bevel 30, on its end juts back slightly at a sharp angle. The degree of incline of the run-on bevel 30 lies outside the automatic locking and effects the lifting of the pin 18 when it is in contact with the bevel. Upon reaching the upper side of the horizontal leg 27'', the pin then drops, under the action of gravity, into the guide slot 19. The corresponding trap function can be noted particularly clearly from FIGS. 8 and 9. The chamfered end of the pin has a favorable effect in assisting the upward camming or guidance of the pin. The chamfering is even effected to such an extent that one can practically speak of a downward tapering conical frustum. Accordingly, the mutual engagement of the coupling means can be brought about conveniently and without damage by the closing movement of the door 9.

As shown in FIGS. 4 and 6, the guide slot 19 is constructed of two sections of lateral symmetry. The axis of symmetry is designated z—z (see FIG. 6). This suitable construction permits the use of the same bracket 27 for both the right-hand opening door stop and the left-hand opening door stop.

The relatively short slot section a, which is parallel to the door and adjoins the back of the mouth end 19', passes, via a pin-side deflecting step section or offset 31, into a longer linear section b (see FIG. 6) which also extends parallel to the inner surface 9' of the door. The offset 31, here corresponds approximately to the inside dimension of the slot groove. By this measure, the parallelism is substantially maintained between the door's inner surface 9 and the corresponding wall-surface section 17 of the pail 1, during the positive-guidance phase.

Figure 11:
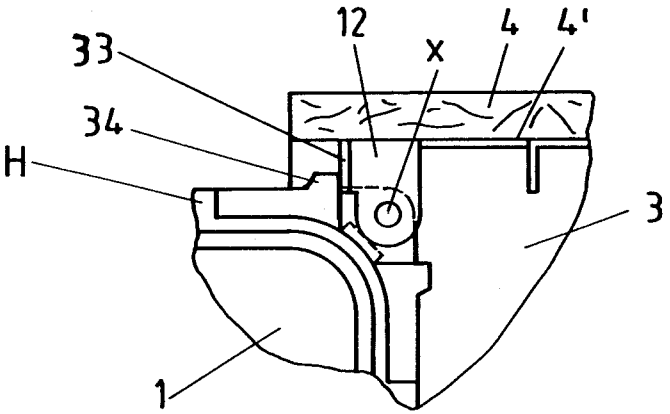
FIG. 11 is a view similar to FIG. 10 and shows the corresponding limiting position of the swing-out pail support.
Figure 10:
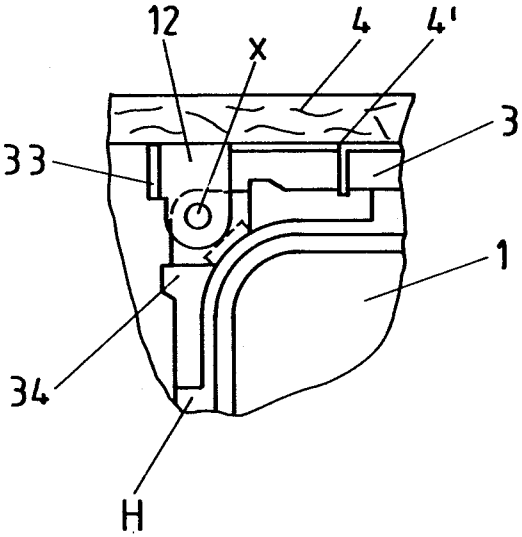
FIG. 10 is a top plan view of the top pivot point located between the pail support and the vertically extending bearing pin, in which the bearing block which receives the bearing pin, has means for limiting the 90° swung-out position of the pail.

The 90° swung-out position of the pail, and respectively, of the support H is limited by a stop. Reference is directed to FIGS. 10 and 11. FIG. 10 shows the situation with the door closed, and FIG. 11 shows the swung-out position. The corresponding limitation is achieved by further development, for example, of the upper cover-side bearing bracket 12. On the horizontal upper bearing lug thereof, a horizontal leg 12 was formed during machine stamping, a portion is bent off upwardly. It extends into the region of swing of a counter stop 34, developed from the support H. Also, with reference to a righ-hand/left-hand stop, a development with angular symmetry is also effected with respect to the support H, in the manner that two bearing brackets or blocks 20 (see FIG. 1) are present at the height of the support 15, as mirror images to the 90° angle bisector.

The function, briefly, is as follows. By the swinging open of the door 9, the garbage pails are swung out from the cabinet as a result of the coupling means K. They can be freely grasped.

For example, for purposes of cleaning, the door 9 can be swung beyond the 90° position, which takes place with automatic release of the coupling means K, the slot 19 leaving the pin 18.

After the reinsertion of the emptied pail on the support H or pails, the mouth end 19' of the guide slot 19 again catches the pin 18 which represents part of the coupling, in a specific end position of the support. In connected state, support and door move back into their basic position shown in FIG. 1.

In the capture-correct position of the end of the mouth 19 is not present and the bracket 27 therefore approaches the pin 18 from the longitudinal edge 29, then, as a result of the run-on bevel 30, there results a sort of trapping function which, preventing the destruction of the coupling unit, leads to proper coupling.

Otherwise, the coupling K can be disengaged by pulling on the grip 26 of pin 18.

I claim:

1. A garbage pail apparatus, mountable in a cabinet having a swingable access door, and having a vertical bearing axis on a side of an outer surface of a garbage pail, comprising pail support means on said axis for supporting said pail, coupling means for operatively coupling said pail to said door, and wherein said coupling means is for uncoupling said pail from said door automatically upon swinging said door to a predetermined degree.

2. A garbage pail apparatus as claimed in claim 1, wherein said coupling means is for automatically operatively coupling said pail to said door during a closing swinging movement of said door.

3. A garbage pail apparatus as claimed in claim 1, wherein said coupling means is for automatically uncoupling said pail from said door when said door is opened greater than said predetermined degree.

4. A garbage pail apparatus as claimed in claim 3, wherein said predetermined degree is about 90°.

5. A garbage pail apparatus as claimed in claim 1, wherein said coupling means comprises a first bracket forming a guide slot, and a section bracket, one of said brackets being connected to said door and the other of said brackets being connected to said pail support means, and a guide pin vertically displaceable in said second bracket and slidably engageable in said guide slot when said guide pin is in one vertically displaceable position, and said guide pin disengages from said guide slot when said guide pin is in another vertically displaceable position.

6. A garbage pail apparatus as claimed in claim 5, wherein said guide pin is located in a bottom region of said pail support means and said guide slot is at said door.

7. A garbage pail apparatus as claimed in claim 5, wherein said guide pin is disengaged from a mouth end of said guide slot when said door is opened greater than approximately 90°.

8. A garbage pail apparatus as claimed in claim 5, wherein said first bracket has a run-on bevel edge on a longitudinal side of said first bracket facing said guide pin, said beveled edge is adapted to vertically displace said guide pin so as to enter said guide slot upon said beveled edge pushing against said guide pin.

9. A garbage pail apparatus as claimed in claim 5, wherein said first bracket is connectable to said door such that said guide pin enters and exits a lateral end of said guide slot upon coupling and uncoupling, respectively, said coupling means, said guide slot defines two laterally symmetrical sections such that said first bracket is connectable to and useable for left-hand, and respectively, right-hand swinging doors.

10. A garbage pail apparatus as claimed in claim 5, wherein said guide slot has a mouth end and a linear section, said mouth end of said guide slot being connected to said linear section of said guide slot, said first bracket is connected to said door and said linear section extends substantially parallel to an inside surfrace of said door.

11. A garbage pail apparatus as claimed in claim 5, wherein said second bracket is a bearing bracket attached to said pail support means, said guide pin has a grippable top and stop means for limiting vertical displacement of said guide pin in said bearing bracket.

12. A garbage pail apparatus, as claimed in claim 1, wherein said coupling means when operatively coupling said pail to said door swings out said pail during swinging open of said door, and wherein said apparatus further comprises stop means for limiting the angle of swinging-out of said pail to about 90°.

13. A garbage pail apparatus as claimed in claim 1, wherein said coupling means further comprises two bearing brackets arranged on said pail support means spaced apart from each other by 90° with angular symmetry useable for left-hand and respectively right-hand swinging doors.

* * * * *